United States Patent [19]

Shuie

[11] Patent Number: 4,998,611

[45] Date of Patent: Mar. 12, 1991

[54] COIN DISTINGUISHING MECHANISM FOR A COIN KEEPER

[76] Inventor: William Shuie, P.O. Box 10780, Taipei, Taiwan

[21] Appl. No.: 412,185

[22] Filed: Sep. 25, 1989

[51] Int. Cl.[5] ..... A45C 1/12

[52] U.S. Cl. ..... 194/337; 194/219; 194/334; 446/8

[58] Field of Search ..... 446/8, 9; 194/215, 219, 194/334, 337, 351; 453/58; 232/4 R, 7

[56] References Cited

U.S. PATENT DOCUMENTS

| | | | |
|---|---|---|---|
| 2,330,871 | 10/1943 | Cookson | 194/334 |
| 2,622,803 | 12/1952 | Farber | 446/8 X |
| 2,628,028 | 2/1953 | Malnick | 446/9 X |
| 2,973,074 | 2/1961 | Haverstick | 194/334 X |
| 3,825,729 | 7/1974 | Menke | 194/219 X |
| 3,977,507 | 8/1976 | Kaiser | 194/334 X |
| 4,673,368 | 6/1987 | Bush | 446/8 |
| 4,811,828 | 3/1989 | Gotmann et al. | 194/351 |

*Primary Examiner*—Robert J. Spar
*Assistant Examiner*—Scott L. Lowe

[57] ABSTRACT

A coin distinguishing mechanism, installed preferably in a coin keeper, capable of discriminating coins of varying denominations and adding up the total value of the coins being kept therewithin. The coin distinguishing mechanism includes a coin slot means having a passageway which is defined on one side by a fixed element and the other side by a movable element. The movable element is generally kept to the same position by an elastic means. As the movable element is forced to move by a coin passing through the passageway, the moving distance will be magnified by a magnifying mechanism, and an attached arm with a conductive wiper having a first and a second contact ends is thereby actuated. The conductive wiper moves, for a distance magnified in accordance with the moving distance of the movable element, and makes contact on a circuit board by its two contact ends to generate signals indicating the denomination of the inserted coin to a circuitry for displaying the denomination of each insertion as well as calculating the total value of the coins in the coin keeper. The circuit board can detect the inserted coins of various diameters precisely by the specific contacts made by the conductive wiper.

2 Claims, 2 Drawing Sheets

COIN DISTINGUISHING MECHANISM FOR A COIN KEEPER

FIELD OF THE INVENTION

The present invention relates to a coin distinguishing mechanism applicable to coin keepers or toy banks.

BACKGROUND OF THE INVENTION

Conventional toy coin banks do not automatically recognize coin denomination. U.S. Pat. No. 4,673,368 of Vincent N. Bush, in view of this, discloses a toy bank with a novel coin discriminating mechanism. Bush has given a detailed description on conventional toy coin banks in "The Background of the Invention" of his specification and he discloses a new toy bank capable of detecting automatically the denomination of the inserted coins.

Bush's disclosure has taken U.S. coins, e.g. penny and dime which are only 1.1 mm different in diameters, as his sample coins, however, chances are that there is a great difficulty in measuring precisely such a micro difference in diameters as menitoned above. As everyone knows, it is not unusual to make errors in the production line and assembly line of the mechanism parts. Concerning to the structure of the discriminating mechanism in Bush's disclosure, such possible errors may easily cause an error in the discrimination for coins with micro differences in diameters. Though Bush did provide a certain mechanism to detect coins of various diameters, and even if the errors made can be adjusted and the mechanism parts can be reassembled, it is obvious that, a considerable cost for quality control of such mechnism as well as the extra cost for reassembly in the production line will be unavoidable.

SUMMARY OF THE INVENTION

The object of the present invention is to provide a more precise coin discriminating mechanism which can distinguish accurately the denomination of a coin being inserted and passing through the passageway in the coin keeper, even if the inserted varying coins are provided with microdifferences in diameters.

A sound or light effect can be electrically provided in the mechanism to respond to the detecting results. Furthermore, the distinguishing mechanism is also capable of adding up the total value of coins inserted. A coin keeper with such functions may effectively increase the interest of the owner to insert coins. Besides, a digital display of the distinguishing mechanism being supported with an appropriate circuitry can further function as a timer, and reasonably, there will be an apparatus adopted for functions of memory and return-to-zero. Applying the aforementioned additional apparatus to a coin keeper or a toy bank it achieves an interesting and durable toy bank which can be produced facilitatively and is of multifunction.

The distinguishing apparatus of the present invention has a magnifying mechanism for mechanically magnifying the measurement of a coin's diameter. A penny and a dime, for example, which have a difference in diameter of merely 1.1 mm, can be measured with the magnifying mechanism of the present invention to show a greater difference between the two coins, such as 2.2 mm, 3.3 mm, or even greater.

DETAILED DESCRIPTION OF THE INVENTION

Figure 1:
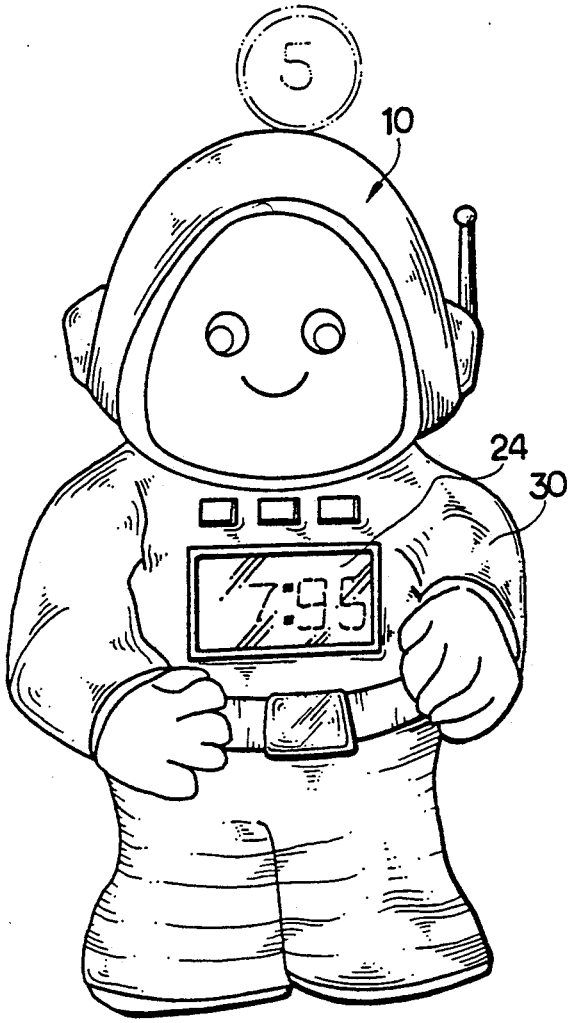
FIG. 1 is a front elevation of an embodiment of the present invention.

The coin distinguishing apparatus of the present invention includes a coin denomination detecting means 10, a circuitry 20, and/or furthermore, a container, having a coin slot means, which can be a doll toy bank 30 as shown in FIG. 1 or a temporary coin keeper in a vending machine.

Figure 2:
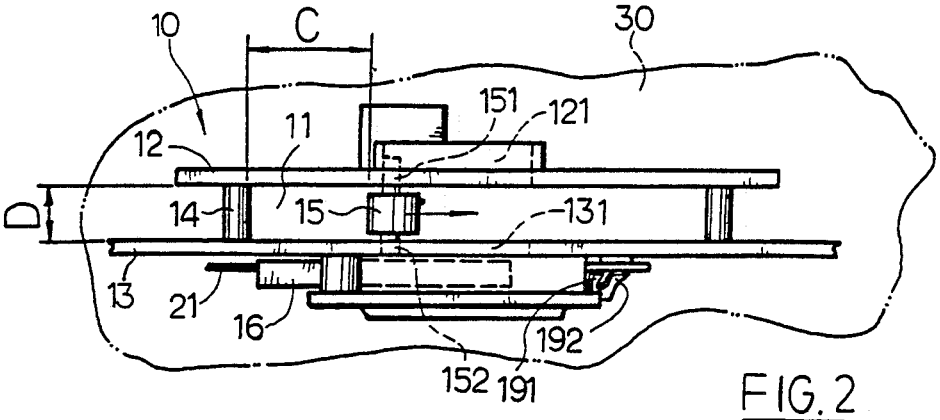
FIG. 2 is a top view of the coin distinguishing mechanism of the invention.
Figure 3:
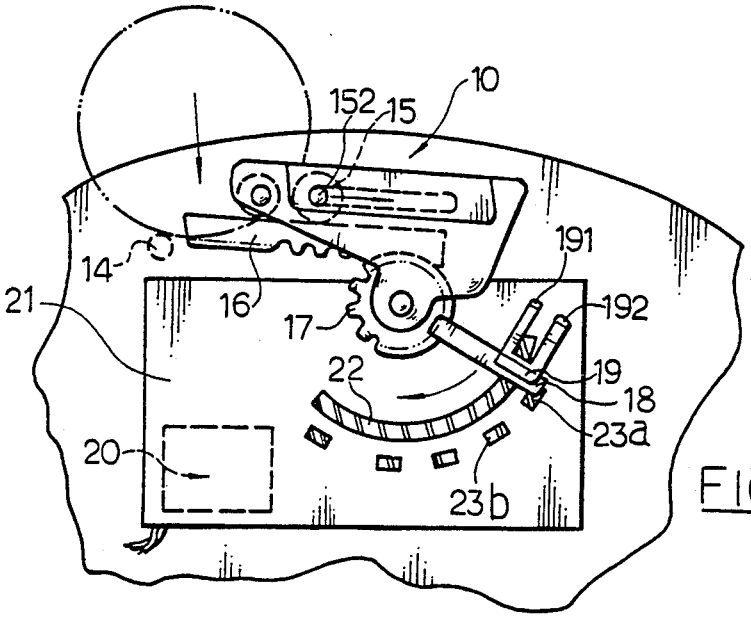
FIG. 3 is an exploded front elevation of the coin distinguishing mechanism.
Figure 4:
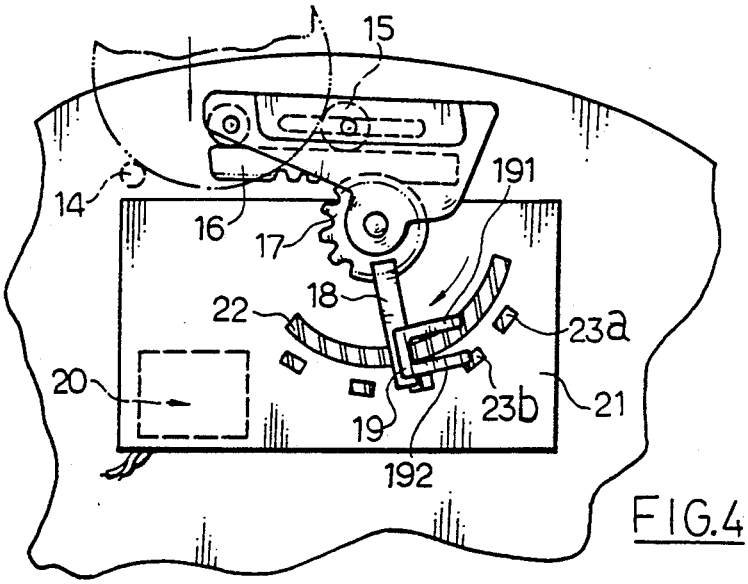
FIG. 4 is another front view showing the operation of the coin distinguishing mechanism in FIG. 3.

Referring now to the embodiment in FIGS. 2, 3 and 4. The coin denomination detecting means 10 is provided with a passageway which the width is defined by a pair of flat walls 12 and 13 spaced by a certain distance D, a measurement greater than the thickness of the thickest coin, and the breadth is defined by a pair of elements 14 and 15, one of which is movably disposed respectively to both side of the passageway and generally spaced from the other element by a distance C, a measurement less than the smallest coin diameter. The movable element 15 is provided with a shaft having two ends 151 and 152 to keep this element 15 moving along the guiding slots 121 and 131 and between the walls. The second end 152 of the shaft is attached with a rack 16 for engaging to a pinion 17 which is further affixed with an arm 18. FIG. 4 illustrates the moved position of these aforegoing means which have been actuated consequently by an inserted coin.

The arm is provided with an elastic conductive wiper 19 having a first and a second contact ends 191 and 192 to make contact respectively with an arched conductive strip 22 and a plurality of contact segments 23*a*, 23*b*, . . . lined in arc on a circuit board 21. Taking the center of the pinion 17 as a central point, there will be two different radii formed respectively from the axle to the first and the second contact ends 191 and 192 whereby the above indicated arc lines of both the conductive strip 22 and the lined contact segments are made.

The contact segments are spaced according to the varying coin diameters, which will be discussed in further detail hereinafter. However, these segments 23*a*, 23*b*, . . . are electrically connected with the detecting means 10 of the circuitry 20 to generate respectively varying signals for detection of the coin denominations.

As a coin is inserted into the coin slot and is pressed to pass the passageway 11, it forces the movable element 15 to move along and between the two opposite guiding slots 121 and 131, thus the rack attached thereon will also be moved and rotate the pinion 17 to actuate the arm 18 moving clockwise. The larger the inserted coin is, the farther the arm moves. The two contact ends 191 and 192 contact respectively with the conductive strip 22 and the contact segments and by and the movement of the arm to generate signals in response to the insertion, and thereby provide signals concerning the denomination of the inserted coin to be displayed on the display window 24 as illustrated in FIG. 1.

Since there are some coins with microdifferences in diameters, errors made in a production line or assembly line, in the construction of coin distinguishing means of the conventional type could result in erroneous coin diameter readings. To overcome this danger, the present invention employs a rack together with a pinion to actuate an arm, and in view of that the length of the arm, as well as the distances between the axle and the respective contact ends, are greater than the pitch diameter of the pinion, thus forming a magnifying mechanism for enlarging the moving distance, and the conductive wiper is thereby moved to a distance greater than the relative moving distance of the rack. Consequently, the contact segments are arranged and spaced from each other with appropriate greater distances which will reduce the probability of erroneous coin diameter readings due to errors in the production process of the coin distinguishing means.

It is to be understood that the aforegoing embodiment is described herewith for merely explaining the practicality of the present invention. There are still some variations which can be developed by taking the main idea of the present invention as basis, for example the movable element 15 can be either a short pin or a non-column means with the same function for the detecting means. Therefore, it is not expected to be treated as a limitation of the scope of the claims.

I claim:

1. A coin distinguishing apparatus for discriminating coins of various diameters, comprising:

a. a container having a coin slot means in the surface for coins to be inserted, said slot means having a passageway defined by two generally flat, opposite walls spaced by a distance greater than the width of a coin, and two elements, wherein one of which is movable by a and spaced from the other of said two elements by a distance less than the diameter of a smallest coin to be distinguished;

b. a rack, affixed to said movable element, disposed within the passageway and being moved together with said movable element in response to the insertion of coins;

c. detection means operatively connected with said rack for detecting movement of said movable element with said rack, and said movement being related to the coin diameter whereby when a coin is inserted through the passageway and is obstructed by the other of said two elements on one side of the passageway, said coin will be forced toward the other side of the passageway and displace said movable element to a distance related to the coin diameter, which displacement is detected by said detection means;

d. the detection means including:

a pinion, being attached to said rack;

a conductive wiper having a first and a second contact ends;

an arm, connecting said pinion and said conductive wiper respectively by its both ends;

an arched conductive strip and plurality of contact segments each corresponding to a particular coin size;

said contact segments are lined in an arc of a circle having the axle of the pinion as its center; said first and second contact ends are spaced from the axle of the pinion by a distance greater than a pitch diameter of said pinion; said conductive wiper is actuated with said pinion, and said first and second contact ends electrically contact with the conductive strip and contact segments respectively for the detection.

2. The apparatus of claim 1 wherein said container includes a display means which is interconnected with the said detection means for displaying the denomination of the coin being inserted and the total value.

* * * * *